US009255497B2

(12) United States Patent
Whiston et al.

(10) Patent No.: US 9,255,497 B2
(45) Date of Patent: Feb. 9, 2016

(54) CAMSHAFT TO CONTROL VALVE TIMING

(71) Applicant: Ford Global Technologies, LLC, Dearborn, MI (US)

(72) Inventors: Philip John Whiston, Ingatestone (GB); Robert Tynan, Kent (GB)

(73) Assignee: Ford Global Technologies, LLC, Dearborn, MI (US)

( * ) Notice: Subject to any disclaimer, the term of this patent is extended or adjusted under 35 U.S.C. 154(b) by 214 days.

(21) Appl. No.: 13/857,053

(22) Filed: Apr. 4, 2013

(65) Prior Publication Data

US 2013/0276732 A1 Oct. 24, 2013

(30) Foreign Application Priority Data

Apr. 20, 2012 (GB) ..... 1206939.9

(51) Int. Cl.

| | |
|---|---|
| ***F01L 1/34*** | (2006.01) |
| ***F02D 13/00*** | (2006.01) |
| ***F01L 1/047*** | (2006.01) |
| ***F01L 1/053*** | (2006.01) |
| *F02M 25/07* | (2006.01) |
| *F02B 75/18* | (2006.01) |

(52) U.S. Cl.

CPC ..... *F01L 1/047* (2013.01); *F01L 1/053* (2013.01); *F01L 2001/0537* (2013.01); *F01L 2800/08* (2013.01); *F02B 2075/1816* (2013.01); *F02M 25/0752* (2013.01)

(58) Field of Classification Search

CPC ..... F01L 1/047

USPC ..... 123/90.6, 90.15–90.18, 345, 348, 321

See application file for complete search history.

(56) References Cited

U.S. PATENT DOCUMENTS

| | | | | |
|---|---|---|---|---|
| 5,606,942 | A | 3/1997 | Tsuzuku et al. | |
| 6,631,701 | B2 * | 10/2003 | Seader et al. | 123/90.6 |
| 7,204,214 | B2 * | 4/2007 | Miyaji et al. | 123/90.15 |
| 7,424,874 | B2 * | 9/2008 | Takamiya et al. | 123/90.15 |
| 7,487,751 | B2 * | 2/2009 | Baeuerle | 123/90.15 |
| 8,191,519 | B2 * | 6/2012 | Wermuth et al. | 123/90.15 |
| 2008/0257300 | A1 | 10/2008 | Lyon | |
| 2013/0152884 | A1 * | 6/2013 | Min et al. | 123/54.1 |

FOREIGN PATENT DOCUMENTS

| | | | |
|---|---|---|---|
| JP | 2001182569 | A | 7/2001 |
| JP | 2006104999 | A | 4/2006 |

* cited by examiner

*Primary Examiner* — Thai Ba Trieu
*Assistant Examiner* — Ngoc T Nguyen
(74) *Attorney, Agent, or Firm* — Julia Voutyras; Alleman Hall McCoy Russell & Tuttle LLP

(57) ABSTRACT

A camshaft for a multiple cylinder four-stroke internal combustion engine is described wherein peak lift of a first exhaust lobe is angularly displaced relative to peak lift of a second exhaust lobe by an angle of cam rotation greater than an angle defined by a full revolution of the camshaft divided by the number of cylinders of the engine. By increasing the angle between peak lift of exhaust lobes associated with physically adjacent and successive firing cylinders, the exhaust port of an earlier firing cylinder begins to close earlier than a conventional symmetric arrangement and opening of the exhaust port of the subsequently firing cylinder may be delayed. As such the crossover or overlap period when two exhaust ports are open may be reduced, which thereby reduces the transfer of exhaust gas from one cylinder to another.

18 Claims, 6 Drawing Sheets

CAMSHAFT TO CONTROL VALVE TIMING

CROSS REFERENCE TO RELATED APPLICATIONS

The present application claims priority to United Kingdom Patent Application 1206939.9, filed on Apr. 20, 2012, the entire contents of which are hereby incorporated by reference for all purposes.

FIELD

The present description relates to a four cylinder inline internal combustion engine. More particularly, the system described relates to a camshaft for a multiple cylinder four stroke internal combustion engine.

BACKGROUND AND SUMMARY

Cylinders of a multiple cylinder engine are arranged to sequentially have their power strokes, which in the art is known as the firing order. The firing order of an engine is primarily determined by the positioning of the cylinder and cranks on the crank shaft, where rotation of the crankshaft causes the reciprocal operation of pistons within the cylinders. For example, a four-cylinder four-stroke engine has power strokes that occur at one-hundred and eighty degree intervals of crankshaft rotation such that the pistons move in pairs within the cylinders. For instance, the pistons in the first and fourth cylinders move as a pair whereas the pistons in the second and third cylinders also move as a pair. As such, in a four cylinder engine having a firing order of 1-3-4-2, when the first piston begins its power stroke the piston in the fourth cylinder begins its induction stroke. Alternatively, the second piston begins its exhaust stroke while the third piston begins its compression stroke.

When a cylinder enters the exhaust stroke the exhaust gases are expelled from the cylinder into an exhaust manifold via exhaust valves. The exhaust manifold collects exhaust gases from each cylinder where it directs the gases to an exhaust pipe or turbocharger within the vehicle. In a typical configuration, an exhaust manifold comprises a number of branches that connect with and extend from individual cylinders at the cylinder head. Therefore, the exhaust manifold comprises multiple inlets and outlets that connect to an exhaust pipe which thereby facilitates eviction of exhaust gases, after treatment, to the atmosphere. The exhaust manifold may be cast or fabricated either as a separate part to the cylinder head of an engine or as an integral part of the cylinder head casting. In the case of an integrated exhaust manifold, the length of the exhaust manifold port runners or branches are kept short to enable the head to be cast and in order to save costs on material.

One problem associated with the exhaust manifold layout is that the exhaust gases from one cylinder can be discharged into another cylinder if any exhaust valve overlap exists. As such, an integrated exhaust manifold may suffer from interference between cylinders, particularly where the exhaust branches from adjacent cylinders (for example the exhaust branches from the third and fourth cylinders) in the manifold are relatively short and the cam duration period is particularly long (e.g., greater than one hundred and eighty degrees crank rotation for a four cylinder engine). Therefore, if the cam duration is longer than 180 degrees of crank rotation, two cylinders most likely have exhaust ports open at the same time such that one port is closing while another port is opening. This results in exhaust gas flowing from the higher pressure cylinder (e.g., the cylinder that has just begun its exhaust stroke) into an adjacent cylinder where a lower cylinder pressure exists as the exhaust port is closing. The consequence of exhaust gas flowing between cylinders is that the fuel mixture within the cylinder may be contaminated by the presence of exhaust gases that further affect combustion efficiency at the next induction stage of the engine cycle.

Attempts to overcome the discharge of exhaust gases from one cylinder to another have been made and include blocking of the discharge in the manifold assembly. However, such solutions involve a redesign of the exhaust manifold layout. Furthermore, in the case of an integrated exhaust manifold, the scope for modifying the exhaust branches are limited due to a desire to maintain the compact arrangement provided by an integrated manifold. It is therefore desirable to reduce the possibility of exhaust gases being discharged from one cylinder to another while also preventing the discharge from one cylinder from blocking the discharge from another cylinder. It is also desirable to reduce the possibility of abnormal combustion, or engine knock, due to the mixture of fuel and exhaust gases in the cylinder following the intake of fuel.

The inventors have recognized disadvantages with the approaches noted above and herein describe a camshaft for a multiple cylinder four-stroke internal combustion engine, wherein each exhaust lobe is arranged to operate an exhaust valve of an associated cylinder upon rotation of the camshaft so that peak lift of a first exhaust lobe is angularly displaced relative to peak lift of a second exhaust lobe by an angle of cam rotation greater than an angle defined by a full revolution of the camshaft divided by the number of cylinders of the multiple cylinder engine. By increasing the angle between peak lift of exhaust lobes associated with physically adjacent and successive firing cylinders, the exhaust port of an earlier firing cylinder begins to close earlier than a conventional symmetric arrangement and opening of the exhaust port of the subsequently firing cylinder may be delayed. As such the crossover or overlap period when two exhaust ports are open may be reduced. Therefore, the period of camshaft rotation during which transfer of exhaust gas from one cylinder to another is also reduced.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 5:
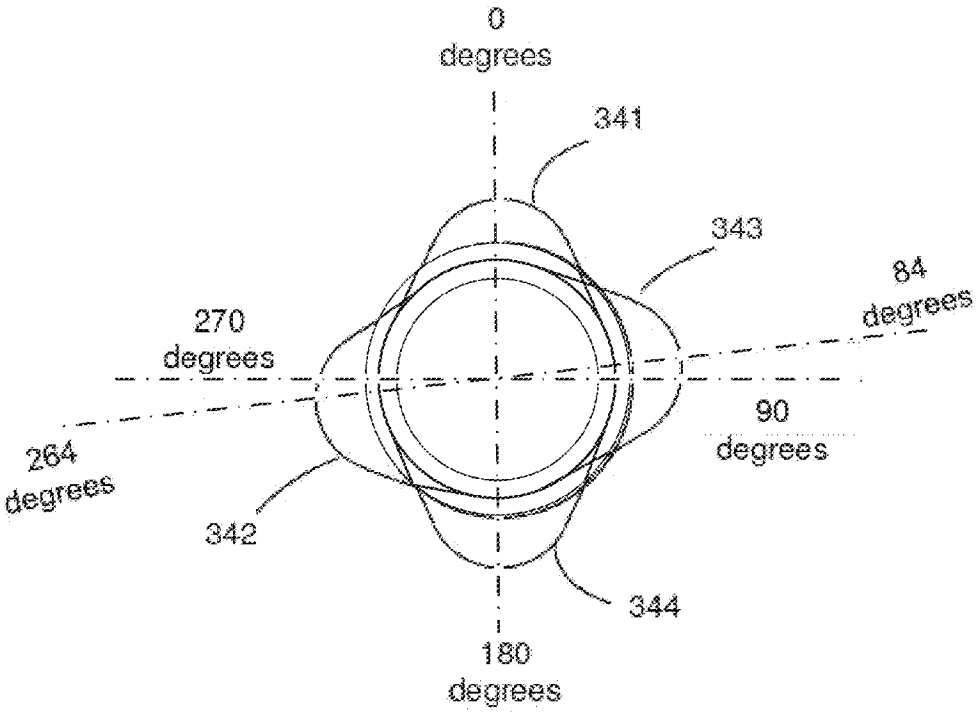
FIG. 5 illustrates a camshaft incorporating an exhaust lobe arrangement according to an embodiment of the present disclosure.

The present description relates to a camshaft for a multiple cylinder four stroke internal combustion engine. Because the method relates to cylinder operation within an engine, in FIG. 1, a schematic diagram of one cylinder of an engine is provided for reference. Then, FIG. 2 shows a perspective view of an exemplary inline four cylinder engine to illustrate how the camshaft is implemented in the sample engine system. Further details of the camshaft are provided in FIGS. 3A-C for a conventional exhaust lobe arrangement that produces valve lift with significant overlap during the engine drive cycle. As such, adjacent exhaust valves may be open simultaneously during certain parts of the drive cycle, which results in the transfer of exhaust gases from one cylinder to another in the manner already described. To reduce the period of overlap when two adjacent exhaust valve ports are open, FIG. 5 illustrates a modified camshaft having an increased angle between the peak lift of exhaust lobes that causes the opening of exhaust ports associated with physically adjacent and successive firing cylinders to be delayed. Then, in FIG. 6 a graphical representation of exhaust valve lift for the camshaft of FIG. 5 is shown to illustrate how the period of overlap between physically adjacent and successive firing cylinders is reduced to further reduce the transfer of exhaust gases between successively firing cylinders.

The term "physically adjacent" will be understood to relate to the arrangement of the exhaust lobes in relation to the physical placement/location of the associated cylinders. The cylinders are numbered sequentially from one to four in the case of a four cylinder engine. Therefore, the first cylinder is physically adjacent to the second cylinder, the second cylinder is physically adjacent to the third cylinder and the third cylinder is physically adjacent to the fourth cylinder. As such, the exhaust lobe associated with the first cylinder (cylinder one) can be considered physically adjacent to the exhaust lobe associated with the second cylinder (cylinder two), which is physically adjacent to the exhaust lobe associated with the third cylinder (cylinder three), which is physically adjacent to the exhaust lobe associated with the fourth cylinder (cylinder four).

Figure 1:
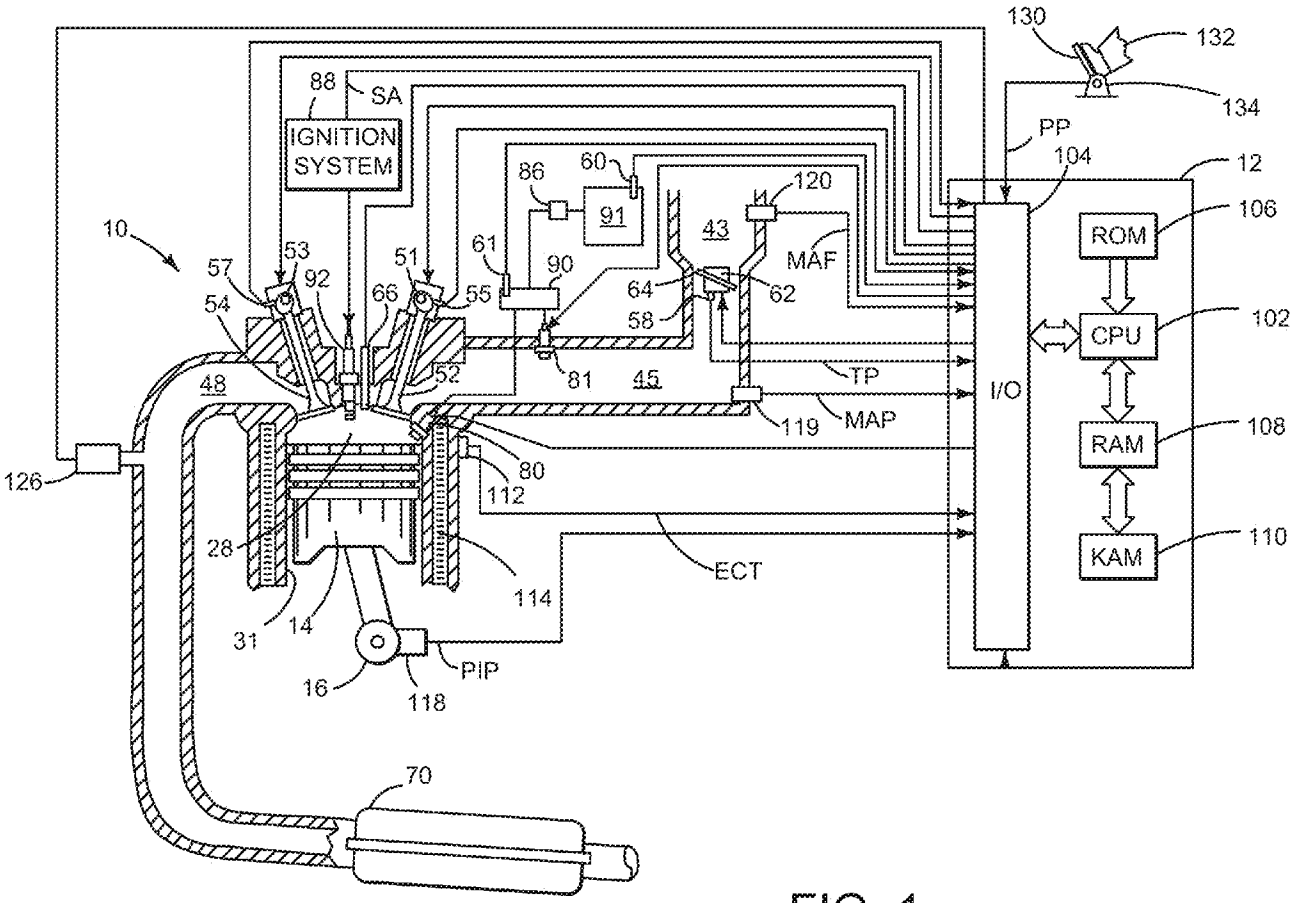
FIG. 1 is a schematic diagram of one cylinder of an engine.
Figure 2:
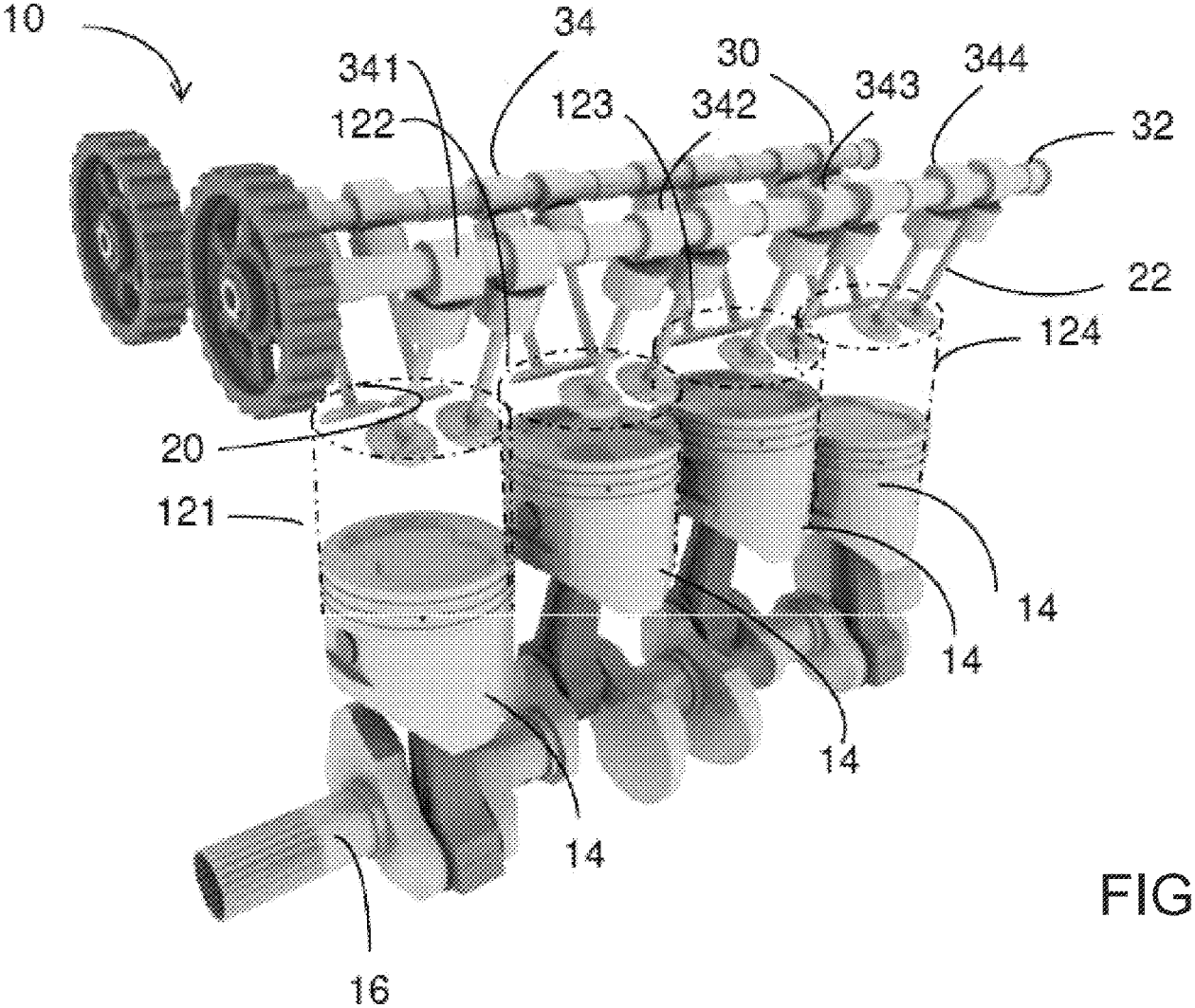
FIG. 2 illustrates a perspective view of an inline four cylinder four stroke engine.

Referring to FIG. 1, internal combustion engine 10, comprising a plurality of cylinders, one cylinder of which is shown in FIG. 1, is controlled by electronic engine controller 12. Engine 10 includes combustion chamber 28 and cylinder walls 31 with piston 14 positioned therein and connected to crankshaft 16. Combustion chamber 28 is shown communicating with intake manifold 45 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Direct liquid fuel injector 66 is shown positioned to inject liquid fuel directly into cylinder 28, which is known to those skilled in the art as direct injection. Alternatively, liquid fuel may be injected to an intake port, which is known to those skilled in the art as port injection. Direct liquid fuel injector 66 delivers liquid fuel in proportion to the pulse width from controller 12. Liquid fuel is delivered to direct liquid fuel injector 66 by a fuel system (not shown) including a fuel tank, fuel pump, and fuel rail (not shown).

Direct gaseous fuel injector 80 is shown positioned to inject gaseous fuel directly into cylinder 28. Port gaseous fuel injector 81 is shown positioned to inject gaseous fuel into intake manifold 45. In some examples, port gaseous fuel injector 81 may be positioned in an intake port of a cylinder head. In other examples, gaseous fuel injector 81 may inject gaseous fuel into a central area of an intake manifold. Both direct gaseous fuel injector 80 and port gaseous fuel injector 81 may provide gaseous fuel to engine 10. However, gaseous fuel may be supplied solely via direct gaseous fuel injector 80 without port gaseous fuel injector 81 in other examples. Additionally, gaseous fuel may be supplied solely via port gaseous fuel injector 81 without direct gaseous fuel injector 80 in still other examples.

Direct gaseous fuel injector 80 and port gaseous fuel injector 81 receive gaseous fuel via fuel rail 90 and storage tank 91. Pressure regulator 86 controls pressure that is delivered to fuel rail 90 by storage tank 91. Pressure of gas in storage tank 91 is sensed via pressure sensor 60. Pressure of gas in fuel rail 90 is sensed via pressure sensor 61. Direct gaseous fuel injector 80 and port gaseous fuel injector 81 may be controlled independently by controller 12 so that each delivers different flow rates at different times.

Intake manifold 45 is shown communicating with optional electronic throttle 62 that adjusts a position of throttle plate 64 to control air flow from air intake 43 to intake manifold 45. Electronic throttle 62 is shown positioned in between intake manifold 45 and air intake 43.

Distributorless ignition system 88 provides an ignition spark to combustion chamber 28 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 119 coupled to intake manifold 45; an engine position sensor from a Hall effect sensor 118 sensing crankshaft 16 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 28 via intake manifold 45, and piston 14 moves to the bottom of the cylinder so as to increase the volume within combustion chamber 28. The position at which piston 14 is near the bottom of the cylinder and at the end of its stroke (e.g. when combustion chamber 28 is at its largest volume) is typically referred to by those of skill in the art as bottom dead center (BDC). During the compression stroke, intake valve 52 and exhaust valve 54 are closed. Piston 14 moves toward the cylinder head so as to compress the air within combustion chamber 28. The point at which piston 14 is at the end of its stroke and closest to the cylinder head (e.g. when combustion chamber 28 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 14 back to BDC. Crankshaft 16 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and as described herein intake and exhaust valve opening and/or closing timings may vary, such as to provide positive or negative valve overlap, late intake valve closing, or various other examples.

Turning to FIG. 2 where engine 10 is shown as an inline four cylinder four stroke engine type. The illustrated engine 10 comprises four cylinders. As noted above, the cylinders are generally referred to by numbers, for example an inline four cylinder four stroke engine comprises four cylinders referred to as cylinder 1, 2, 3 and 4. In the following the cylinders will be referred to as first cylinder 121, second cylinder 122, third cylinder 123 and fourth cylinder 124. The illustration in FIG. 2 is limited to an inline four cylinder four stroke engine. However, it should be appreciated by those skilled in the art that the present disclosure can be employed in engines comprising multiple cylinders greater than three and for configurations other than inline/straight.

For an inline four cylinder engine having a firing order of 1-3-4-2, the fourth cylinder fires in succession to the third cylinder and the first cylinder fires successively to the second cylinder. In accordance with the present disclosure a plurality of exhaust lobes spaced along a longitudinal axis of an exhaust camshaft for such an engine may be arranged such that the nose or peak lift of the exhaust lobe or lobes associated with, for example, the third cylinder is angularly displaced by a camshaft rotation angle of greater than ninety degrees from the nose or peak lift of the exhaust lobe or lobes associated with the fourth cylinder. Similarly, the nose or peak lift of the exhaust lobe or lobes associated with the second cylinder may be angularly displaced greater than ninety degrees from the nose or peak lift of the exhaust lobe or lobes associated with the first cylinder. Each exhaust lobe is coupled to an exhaust valve of a cylinder that opens and closes based upon rotations of the camshaft.

In a four stroke-cycle, beginning with a piston 14 at top-dead-center (TDC), as the crankshaft 16 rotates the piston 14 reciprocates four times to define the four strokes, each of which results in a different action. During the first stroke piston 14 moves down within the cylinder from TDC towards bottom-dead-center (BDC) and an inlet or intake port into the cylinder (e.g. 121, 122, 123, or 124) opens by action of an intake valve 20 to allow the air and fuel (petrol engine) or air (diesel/direct injection petrol engine) to enter the cylinder. This first stroke is generally known as induction, or simply referred to as the intake stroke. At the end of the first stroke the intake port closes and leaves a charge of fuel/air mixture or air within the closed cylinder. The second stroke of the piston 14 involves compression of the contents of the cylinder by movement of the piston 14 up within the cylinder towards TDC. As the piston moves, the charge of fuel/air or air is compressed at the top end of the cylinder within the combustion chamber (schematically illustrated by dash-dot lines). During the second stroke, or compression stroke, of piston 14, both the intake ports and outlet or exhaust ports are closed. The third stroke of the four-stroke cycle occurs towards the end of the compression stroke and is commonly known as the power stroke. During this stroke, the highly compressed fuel/air mixture in a cylinder becomes hot and, in the case of a petrol engine, a spark plug or ignition system (e.g. spark plug 92 in FIG. 1) provides ignition for the hot fuel/air mixture which subsequently expands and thereby provides power to rotate crankshaft 16. Alternatively, in the case of a diesel engine, fuel is injected into the hot compressed air such that a combustible mixture of fuel/air is created and the heat in the compressed air ignites the mixture. In both cases the fuel/air mixture burns to further increase the air temperature and therefore also increases air pressure within the closed cylinder. The compressed air therefore forces piston 14 down the cylinder and leaves exhaust gas from the burnt fuel within the cylinder. In the final stroke of the four-stroke cycle, continued rotation of crankshaft 16 causes the piston 14 to move towards TDC again. During this exhaust stroke the upward stroke of piston 14 coincides with the lifting of exhaust valve 22 and opening of an exhaust port. Thereby, the upward movement of piston 14 acts to push the exhaust gases out of the cylinder and into the exhaust manifold (not illustrated) that facilitates final expulsion of the exhaust gases from engine 10.

Generally, each cylinder includes at least one intake valve 20 and one exhaust valve 22. However, in example FIG. 2, each cylinder (e.g. 121, 122, 123, 124) is shown with two intake valves 20 and two exhaust valves 22. Although each intake valve and exhaust valve is not explicitly identified for each cylinder, intake valves 20 are coupled to intake camshaft 30 and exhaust valves are coupled to exhaust camshaft 32. The opening and closing operation of intake valve 20 and exhaust valve 22 is controlled by the action of each camshaft (e.g. intake camshaft 30 and exhaust camshaft 32), which herein rotates twice for each revolution of the crankshaft 16. Intake camshaft 30 is located on the intake side and exhaust camshaft 32 is located on the exhaust side of the engine, wherein each camshaft is comprised of lobes/cams 34. Furthermore, each camshaft may be comprised of a plurality of lobes/cams 34, which are spaced along the longitudinal axis of the camshaft and angularly spaced such that the lobes/cams 34 operate to lift intake valves 20 or exhaust valves 22 coupled thereto, which opens intake ports and exhaust ports (not shown) during appropriate times of the four-stroke cycle. For example, the embodiments described herein relate to an exhaust camshaft 32 located on the exhaust side of engine 10. Furthermore, the power strokes of the engine occur at intervals of 180 degrees of rotation of the crankshaft 16 and the pistons 14 move in pairs. In addition, the engine has a firing order 1-3-4-2 so that the exhaust port of the third cylinder 123 is closing as the exhaust port of the fourth cylinder 124 opens. Similarly, the exhaust port of the second cylinder 122 is closing as the exhaust port of the first cylinder 121 is opening, and so on.

Figure 3C:
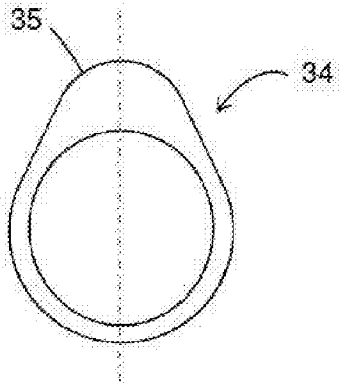
FIG. 3C illustrates a schematic representation of a symmetric exhaust lobe.
Figure 3B:
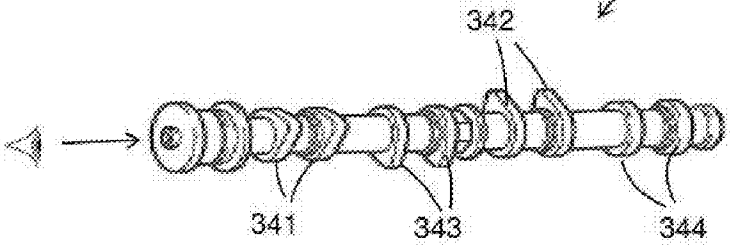
FIG. 3B illustrates a schematic representation of a perspective view of a camshaft for an inline four cylinder four stroke engine.
Figure 3A:
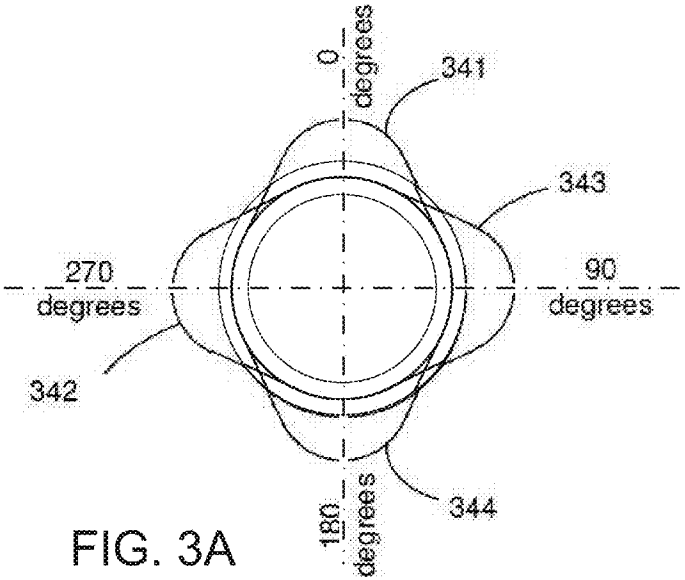
FIG. 3A illustrates a camshaft incorporating a conventional exhaust lobe arrangement for an inline four cylinder four stroke engine.

FIGS. 3A and 3B present a perspective view and a cross-sectional view of a conventional arrangement of exhaust lobes/cams 34 on exhaust camshaft 32. FIG. 3C illustrates a symmetric lobe, which simply means that lobe 34 has a symmetric shape about the centerline shown. Therein nose 35 of lobe 34 generally refers to the region of the lobe that defines a maximum/peak lift that corresponds to opening of the associated exhaust port.

In FIG. 3B, the orientation and spacing of exhaust lobes 341, 342, 343, 344 for a conventional four-stroke four-cylinder engine with firing order 1-3-4-2 is shown. As noted above, the nose or peak lift of exhaust lobes 341 associated with first cylinder 121 facilitates lifting of the exhaust valves 22, which thereby opens exhaust ports within the cylinder. In one embodiment, when lobes 341 are arranged at zero degrees the lobes point in the vertical direction. Therefore, the position of the nose (or peak lift) of exhaust lobes 341 may provide a reference point for the position of exhaust lobes 342, 343, 344 associated with the second, third and fourth cylinders 122, 123, 124 respectively. For example, in the cross-sectional view of FIG. 3A, the nose or peak lift of exhaust lobe 342 is arranged at two hundred and seventy degrees whereas the nose of exhaust lobe 343 is arranged at ninety degrees and the nose of exhaust lobe 344 is arranged at one hundred and eighty degrees. As described above, the nose or peak lift of each exhaust lobe 341, 342, 343, and 344 is the part of the lobe 34 providing the greatest lift and therefore facilitates full movement of exhaust valves 22 to open the exhaust port. As also illustrated in FIG. 3B the nose or peak lift of first exhaust lobe 341 and fourth exhaust lobe 344 are diametrically opposed (separated by one hundred and eighty degrees). Similarly, the nose or peak lift of the second exhaust lobe 342 and the third exhaust lobe 343 are separated by one hundred and eighty degrees.

Figure 4:
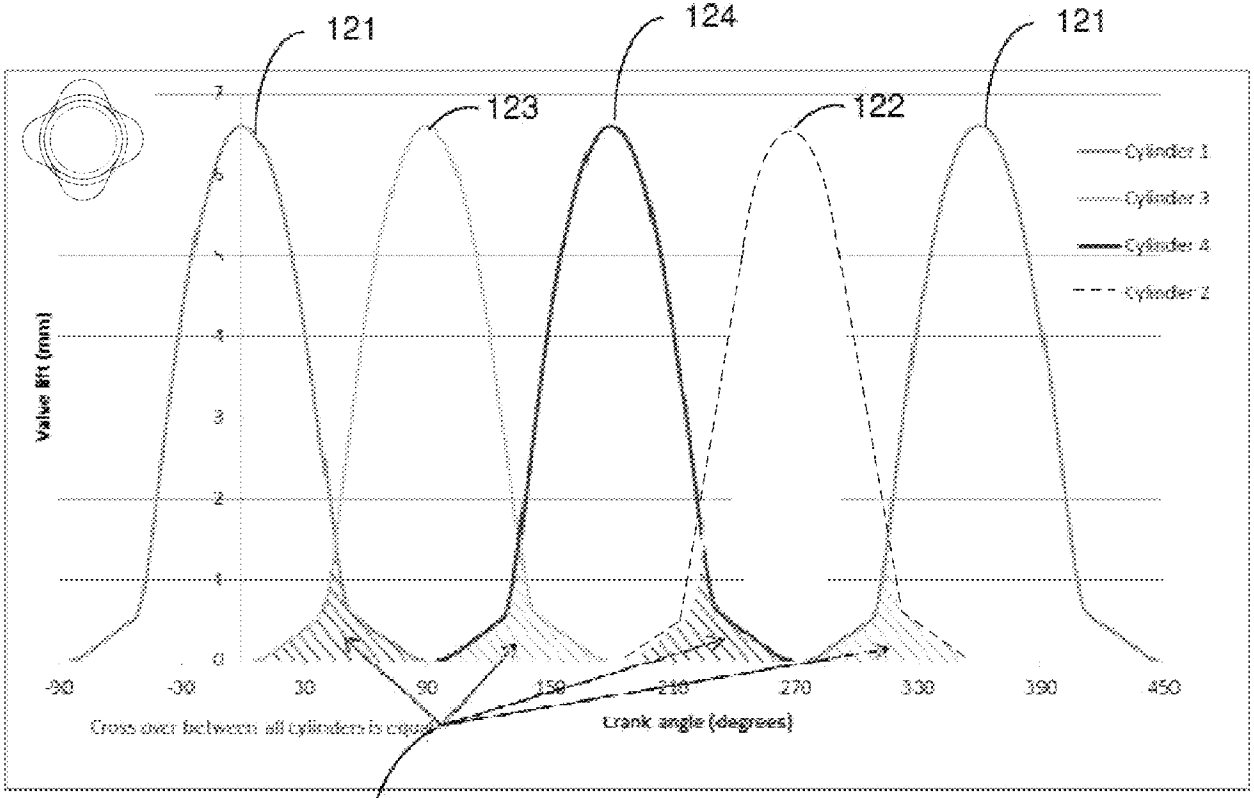
FIG. 4 illustrates a graphical representation of exhaust valve lift for an inline four cylinder four stroke engine comprising a camshaft as illustrated in FIGS. 3A-3C.

In FIG. 4, the graph shown illustrates valve lift (y-axis) against crankshaft angular rotation (x-axis) and shows the point of maximum/peak lift (e.g. corresponding to valve opening) when the nose of the corresponding exhaust lobe lifts the exhaust valve to open an exhaust port. In the example shown, the graph is representative of exhaust valve operation in an engine comprising four cylinders with a firing order 1-3-4-2. Furthermore, the curves are identified using the reference numerals associated with each engine cylinder. Therefore, the curve representing the first cylinder is identified as 121; the curve representing the second cylinder is identified as 122, and so on.

In FIG. 4, the hatched areas 40 under the curves illustrate crossover periods when two sets of exhaust valves are lifted and hence two sets of exhaust ports are simultaneously open. The hatched areas 40 therefore represent the crank rotation period when one exhaust valve is closing and another exhaust valve is opening. As such, the hatched areas 40 indicate a period of time when two cylinders are simultaneously discharging exhaust gases. In FIG. 4, the hatched areas 40 are the same between all curves.

Because some cylinders within the firing order are also arranged physically adjacent to each other in engine 10, the exhaust path from each cylinder (or at least one cylinder) of each pair to the exhaust manifold may be short (not illustrated). Therefore in the example shown, the crossover periods between third cylinder 123 and fourth cylinder 124 and between second cylinder 122 and first cylinder 121 are of increased significance since exhaust gases from one cylinder, for example the first cylinder 121, may enter a second cylinder, for example the second cylinder 122 due to the close proximity of the cylinders during the crossover or overlap period represented by hatched areas 40. When this occurs, a quantity of exhaust gas will remain inside a cylinder when the exhaust ports are closed as the cylinder is primed for the next induction stroke.

Turning to another embodiment of the camshaft, FIG. 5 shows a cross-sectional illustration of exhaust camshaft 32 that is modified according to the present disclosure. Therein, each exhaust lobe 34 has a symmetric profile as described above with respect to the camshaft arrangements illustrated in FIGS. 3A-3C. However, as shown in FIG. 5, the relative angular displacement of the nose or peak lift of the exhaust lobes 34 has changed compared with the diametrically opposed arrangement (separated by one hundred and eighty degrees) illustrated in FIGS. 3A and 3B. Changing the angular displacement of a first exhaust lobe relative to a second exhaust lobe allows for the valve timing to be adjusted. Therefore, the camshaft and method according to the present disclosure allows for controlling the exhaust valve timing. In the figure, the same reference numerals are applied because camshaft 32 also refers to an inline four-stroke four cylinder engine with a firing order of 1-3-4-2. As described above the region of the nose or peak lift is the part of each exhaust lobe that provides the greatest lift and therefore facilitates full movement of exhaust valve 22 to open the exhaust port.

Similar to the example illustrated in FIG. 3A, FIG. 5 shows that the exhaust lobe 341 associated with the first cylinder 121 provides the reference point for angular placement of the remaining three exhaust lobes 342, 343, and 344. In this example, the nose or peak lift of exhaust lobe 342 associated with the second cylinder is arranged at two hundred and sixty four degrees clockwise from exhaust lobe 341 associated with the first cylinder 121, or ninety six degrees counter-clockwise. Furthermore, the nose or peak lift of the exhaust lobe 343 associated with the third cylinder 123 is arranged at eighty four degrees from exhaust lobe 341 associated with the first cylinder 121 and the nose or peak lift of the exhaust lobe 344 associated with the fourth cylinder 124 is arranged at one hundred and eighty degrees from exhaust lobe 341 associated with the first cylinder 121. Thus, similar to the arrangement illustrated in FIG. 3B, the nose or peak lift of the first exhaust lobe 341 and the fourth exhaust lobe 344 are diametrically opposed (separated by one hundred and eighty degrees). Likewise, the second exhaust lobe 342 and the third exhaust lobe 343 are also separated by one hundred and eighty degrees. However, as illustrated in the figure, the nose or peak lift of the dash-dot line through second exhaust lobe 342 and the nose or peak lift of the third exhaust lobe 343 are offset by six degrees from the orthogonal arrangement (e.g. substantially 90 degrees) shown in FIG. 3A. Therefore, relative to the line extending between the first exhaust lobe 341 and the fourth exhaust lobe 344, the relative angular displacement of one exhaust lobe relative to the exhaust lobe associated with the successively firing and physically adjacent cylinder is ninety-six degrees.

Figure 6:
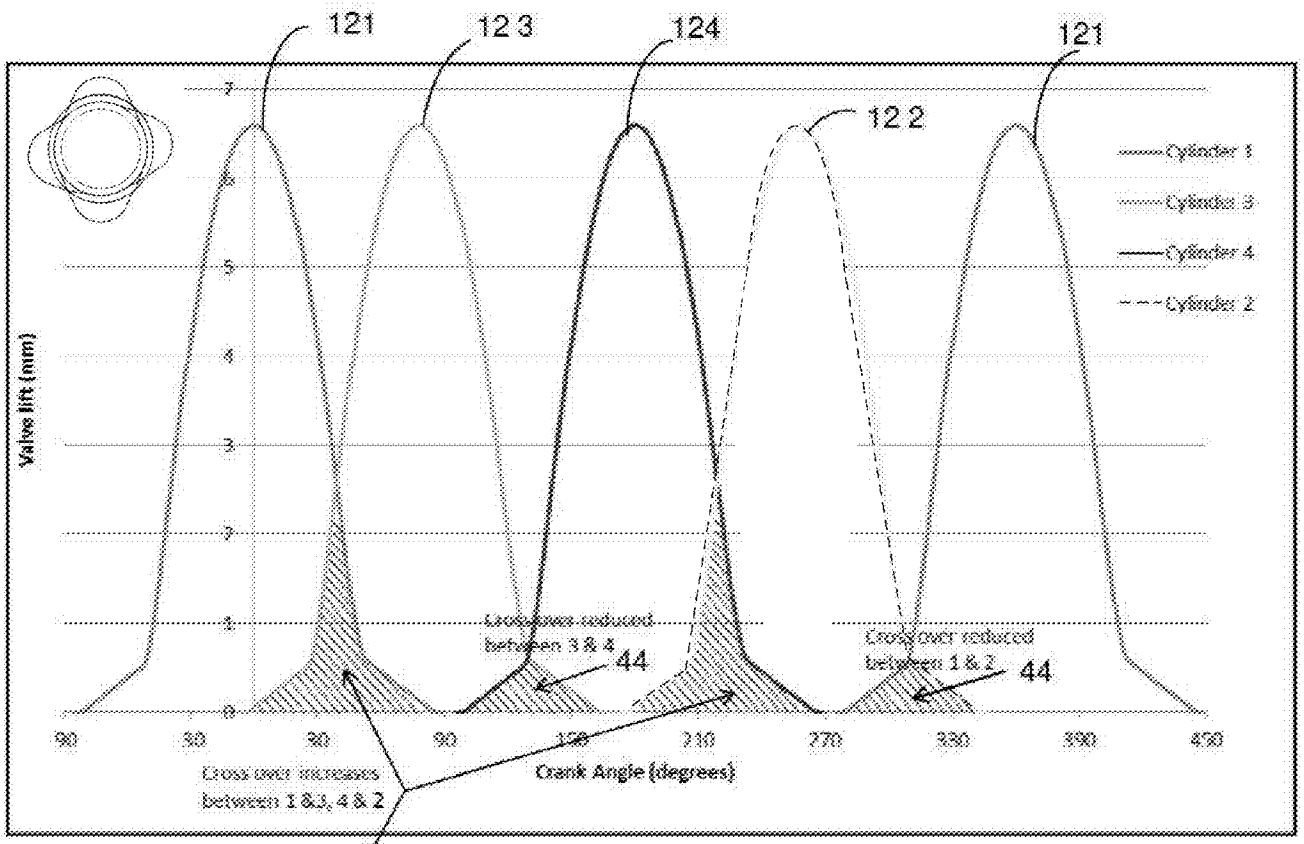
FIG. 6 illustrates a graphical representation of exhaust valve lift for an inline four cylinder four stroke engine comprising a camshaft as illustrated in FIG. 5.

FIG. 6 illustrates valve lift (y-axis) against the crankshaft angular rotation (x-axis) and shows the point of peak lift (valve opening) when the nose of the relevant exhaust lobe lifts the exhaust valve to open the exhaust port. The graph is representative of exhaust valve operation in an engine comprising four cylinders with a firing order 1-3-4-2. Furthermore, the curves are identified using the reference numerals associated with each engine cylinder. Therefore, the curve representing the first cylinder is identified at 121, the curve representing the second cylinder is identified at 122, the curve representing the third cylinder is identified at 123 and the curve representing the fourth cylinder is identified at 124.

As described above with respect to FIG. 4, hatched areas are again present but have an asymmetric shape. As such, the area of a first hatch 42 is shown larger than the area of a second hatch 44, which again corresponds to crossover periods when two sets of exhaust valves are open (or lifted) at the same time. Therefore, the hatched areas represent a period of time when two cylinders are discharging exhaust gases at the same time. The first hatched area 42 and second hatched area 44 represent the crankshaft rotation period when one exhaust port is closing and another exhaust port is opening. The first hatched areas 42 further indicate that the crossover period between the first cylinder 121 and the third cylinder 123 and the crossover period between the second cylinder 122 and the fourth cylinder 124 are increased whereas the second hatched areas 44 represent a reduced crossover period between the third cylinder 123 and the fourth cylinder 124 and between the first cylinder 121 and the second cylinder 122 relative to the arrangement shown in FIGS. 3A and 4. By reducing the crossover period between the third cylinder 123 and the fourth cylinder 124 and between the second cylinder 122 and the first cylinder 121, the period in which two sets of adjacent exhaust ports are open at the same time is reduced. Therefore, the possibility of discharge of exhaust gases from one cylinder to another is reduced.

Advantageously, angular displacement of an adjacent exhaust lobe by a camshaft rotation angle greater than the angle defined by a full revolution of the camshaft divided by the number of cylinders adjusts the timing between closing and opening the exhaust ports of physically adjacent and successive firing cylinders. The period when two exhaust valves are moved and two exhaust ports are open at the same time is reduced by displacing the exhaust lobes associated with successive firing and physically adjacent cylinders by an angle greater than the angle defined by a full revolution of the camshaft divided by the number of cylinders.

It will be appreciated that the exhaust lobes may be distributed with the nose or peak lift at non-uniform angular intervals around the camshaft. For instance, in the case of a four cylinder engine, the opening period is generally ninety degrees of camshaft rotation and one-hundred and eighty degrees of crank rotation. Therefore, by altering the relative angular position of the exhaust lobes the amount of camshaft rotation relative to one-hundred and eighty degree crank rotation is changed and as such crossover or overlap when two exhaust ports are open is reduced. The camshaft according to one embodiment of the disclosure may be adapted for use with an inline four cylinder engine, wherein the engine comprises a first cylinder, a second cylinder, a third cylinder and a fourth cylinder and wherein the camshaft may comprise at least four exhaust lobes spaced on the camshaft such that at least one exhaust lobe is associated with each cylinder of the engine. The nose or peak lift of the exhaust lobes may be distributed at asymmetric angular intervals around the camshaft, wherein the exhaust lobes are arranged at angles other than orthogonal to each other. As such, the occurrence of exhaust gases being discharged from one cylinder to another is reduced.

In another embodiment of the disclosure the camshaft comprises exhaust lobes for the exhaust side of a four cylinder engine, wherein the exhaust lobes associated with at least two cylinders may each be arranged such that their noses or points of peak lift are angularly displaced by greater than ninety degrees relative to the noses or points of peak lift of the exhaust lobes associated with successive firing and adjacent cylinders. The arrangement of the cylinders may therefore operate in first and second pairs and as such the nose or peak lift of an exhaust lobe associated with a cylinder in the first pair may be angularly displaced in relation to the nose or peak lift of an exhaust lobe associated with a cylinder in a second pair.

For example, at least one exhaust lobe may be arranged such that its nose or peak lift is angularly displaced by approximately ninety six degrees relative to the nose or peak lift of an exhaust lobe associated with a successive firing and adjacent cylinder. For instance, the nose or peak lift of the first exhaust lobe may be displaced by ninety six degrees from the nose or peak of the second exhaust lobe in accordance with the first aspect of the present disclosure. Similarly, in the example of an inline four cylinder engine with firing order 1-3-4-2, the nose or peak lift of the exhaust lobe associated with the third cylinder may be at an angle of ninety-six degrees from the nose or peak lift of the exhaust lobe associated with the fourth cylinder.

In still another embodiment, the exhaust lobe associated with at least one cylinder may be arranged such that its nose or peak lift is angularly displaced by between ninety-three degrees and one-hundred and two degrees from the nose or peak lift of an exhaust lobe associated with a successive firing and physically adjacent cylinder. For example, the peak lift of the first exhaust lobe may be angularly displaced from peak lift of the second exhaust lobe by one of ninety-three degrees, ninety-four degrees, ninety-five degrees, ninety-six degrees, ninety-seven degrees, ninety-eight degrees, ninety-nine degrees, one hundred degrees, one hundred and one degrees, and one hundred and two degrees Returning to the modified camshaft of FIG. 6, the exhaust lobes associated with each cylinder consecutively from the first cylinder of a four cylinder engine may be arranged with nose or peak lift oriented at zero degrees, eighty four degrees, one-hundred and eighty degrees and two hundred and sixty four degrees. The second exhaust lobe and the third exhaust lobe are thereby displaced by six degrees of cam rotation and twelve degrees of crank rotation relative to the conventional orthogonal arrangement where each exhaust lobe is located at ninety degree intervals relative to the successively operated exhaust valve. According to the present disclosure, peak lift of the exhaust lobes may be circumferentially spaced non-symmetrically about the longitudinal axis of the camshaft and further circumferentially spaced in non-uniform angular intervals relative to the longitudinal axis of the camshaft.

It will be appreciated that the geometry of the exhaust port, the port length and the amount of back flow into the closing cylinder may influence the amount of angular displacement of the exhaust lobe position relative to the exhaust lobe associated with a successive firing and physically adjacent cylinder. Furthermore, one or more exhaust lobes may comprise an asymmetric profile where an asymmetric profile may affect lobe to tappet interface and thereby affect valve control depending on the amount of asymmetry.

By changing the angular displacement of adjacent exhaust lobes, the timing of exhaust valve lifts may thus be altered. As such the occurrence of exhaust valves associated with more than one cylinder being lifted and the associated exhaust port being open at the same time may be reduced or substantially eliminated in some cases. Therefore, advantages are gained by modifying the angular displacement of exhaust lobes for adjacent cylinders on exhaust camshaft 32, which may result in a cleaner fuel/air mixture in the cylinder at induction and compression so that engine performance is enhanced. The result is a more efficient combustion process that is less likely to suffer from abnormal detonation such as engine knock.

According to one embodiment, the angular placement of the exhaust lobes is non-symmetric when viewed along the length of the camshaft (e.g. see FIGS. 5 and 6). This placement is provided as an example and many other arrangements are possible. However, the camshaft and exhaust lobe are shown with a specific arrangement and angular spacing relationship for an example four cylinder four stroke inline engine. It should be appreciated that the same angular distribution of exhaust lobes may not apply to engines comprising three cylinders, five cylinders, six cylinders etc. Therefore, by changing the angular placement of exhaust lobes in a multiple cylinder engine having more than four cylinders, the crossover may be reduced between adjacent cylinders which reduces or substantially eliminates the discharge of exhaust gases between cylinders. While specific embodiments of the disclosed camshaft have been described, it will be appreciated that departures from the described embodiments may still fall within the scope of the present disclosure.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for controlling exhaust valve timing in a multiple cylinder engine comprising:

angularly displacing a peak lift of a first exhaust lobe of a first cylinder relative to a peak lift of a second exhaust lobe of a second cylinder at an angle other than an angle defined by a full revolution of a camshaft divided by a number of cylinders, wherein the second cylinder is directly physically adjacent to the first cylinder and fires next in succession during a firing cycle.

2. The method of claim 1, wherein one or more exhaust lobes have an asymmetric profile about a centerline of the exhaust lobe.

3. The method of claim 1, wherein the peak lifts of the exhaust lobes are circumferentially spaced non-symmetrically about a longitudinal axis of the camshaft.

4. The method of claim 3, wherein the peak lifts of the exhaust lobes are circumferentially spaced in non-uniform angular intervals relative to the longitudinal axis of the camshaft.

5. A method for a multi-cylinder engine with valve overlap, comprising:

angularly displacing a peak lift of a first exhaust lobe relative to a peak lift of a second exhaust lobe by an angle of cam rotation greater than an angle defined by a full revolution of a camshaft divided by a number of cylinders of the engine, the second exhaust lobe being associated with a cylinder that fires next in succession and located directly physically adjacent to a cylinder associated with the first exhaust lobe.

6. The method of claim 5, wherein the valve overlap is positive valve overlap, and wherein the first and the second exhaust lobes are rigidly fixed to, and spaced along, a longitudinal axis of the camshaft, each exhaust lobe being coupled to an exhaust valve.

7. A camshaft comprising:

a plurality of exhaust lobes spaced along a longitudinal axis, wherein at least one exhaust lobe is coupled to an exhaust valve associated with each cylinder of a multiple cylinder engine; and a peak lift of a first exhaust lobe is angularly displaced relative to a peak lift of a second exhaust lobe by an angle of cam rotation greater than an angle defined by a full revolution of the camshaft divided by a number of cylinders, the second exhaust lobe being associated with a second cylinder that fires next in succession to a first cylinder associated with the first exhaust lobe, the second cylinder located directly physically adjacent to the first cylinder.

8. The camshaft of claim 7, wherein the peak lifts of the first and second exhaust lobes are circumferentially spaced non-symmetrically about a longitudinal axis of the camshaft.

9. The camshaft of claim 8, wherein the peak lifts of the first and second exhaust lobes are circumferentially spaced in non-uniform angular intervals relative to the longitudinal axis of the camshaft.

10. The camshaft of claim 9, wherein the camshaft is adapted for use with an inline four cylinder engine, and wherein the peak lifts of the first and second exhaust lobes are distributed at angles other than orthogonal to each other.

11. The camshaft of claim 10, wherein the first and the second exhaust lobes associated with the first and the second cylinders are arranged such that the peak lift of the first exhaust lobe is angularly displaced by greater than ninety degrees relative to the peak lift of the second exhaust lobe.

12. The camshaft of claim 10, wherein the peak lift of the first exhaust lobe is angularly displaced from the peak lift of the second exhaust lobe from between ninety-three degrees and one hundred and two degrees, including ninety-three degrees and one hundred and two degrees.

13. The camshaft of claim 12, wherein the peak lift of the first exhaust lobe is angularly displaced from the peak lift of the second exhaust lobe by one of:

ninety-three degrees, ninety-four degrees, ninety-five degrees, ninety-six degrees, ninety-seven degrees, ninety-eight degrees, ninety-nine degrees, one hundred degrees, one hundred and one degrees, and one hundred and two degrees.

14. The camshaft of claim 13, wherein the peak lift of the first exhaust lobe is displaced by six degrees of cam rotation and twelve degrees of crank rotation from the peak lift of the second exhaust valve.

15. The camshaft of claim 14, wherein one or more exhaust lobes have an asymmetric profile about a centerline of the exhaust lobe.

16. The camshaft of claim 7, wherein angular displacement of the first exhaust lobe relative to the second exhaust lobe allows for valve timing to be adjusted.

17. The camshaft of claim 16, wherein adjusting the valve timing reduces a valve overlap between physically adjacent valves that fire in succession.

18. The camshaft of claim 17, wherein the reduced valve overlap reduces a transfer of gas between two cylinders.

* * * * *